United States Patent [19]

Ebihara et al.

[11] 4,117,475

[45] Sep. 26, 1978

[54] DRIVER CIRCUIT FOR ELECTROCHROMIC DISPLAY DEVICE

[75] Inventors: Heihachiro Ebihara; Fukuo Sekiya, both of Tokorozawa, Japan

[73] Assignee: Citizen Watch Company Limited, Tokyo, Japan

[21] Appl. No.: 745,138

[22] Filed: Nov. 26, 1976

[30] Foreign Application Priority Data

Dec. 1, 1975 [JP] Japan ..... 50-143762

[51] Int. Cl.[2] ..... G09F 9/32

[52] U.S. Cl. ..... 340/336; 340/166 EL; 340/324 M

[58] Field of Search ..... 340/336, 324 EC, 324 M, 340/166 EL; 350/160 R, 332; 315/169 R, 169 TV

[56] References Cited

U.S. PATENT DOCUMENTS

| | | | |
|---|---|---|---|
| 3,968,639 | 7/1976 | Berets et al. | 350/160 R |
| 3,987,433 | 10/1976 | Kennedy | 340/336 |
| 4,001,809 | 1/1977 | Fukui et al. | 340/166 EL |
| 4,006,585 | 2/1977 | Tamaru et al. | 350/160 R |

*Primary Examiner*—Nelson Moskowitz
*Assistant Examiner*—Lawrence Goodwin
*Attorney, Agent, or Firm*—Frank J. Jordan

[57] ABSTRACT

In an electro-optical display device having a persistence property, a driving voltage is immediately applied to each display element after both electrodes of the display element are short-circuited in anticipation of a driving operation intended to reverse the state of a display.

11 Claims, 7 Drawing Figures

LOGIC CIRCUIT
DECODER

DRIVER CIRCUIT FOR ELECTROCHROMIC DISPLAY DEVICE

This invention relates to driver circuits for electro-optical display devices and, more particularly, to an improvement over such driver circuits.

In electronic timepieces employing electrochromic display devices, power consumption is reduced by making use of a driving method in which the driving voltage is applied only when the state of the display is to be changed, thereafter allowing the persistence property of the device to maintain the state so induced. There are also cases in which the driving voltage is applied in a supplementary manner in order to compensate for inadequate display persistence even when no change in display is intended.

A number of disadvantages are encountered with the conventional driving method. These disadvantages are listed as follows:

(1) When isolating the power source from the circuit for the purpose of exchanging the battery the driver circuit suffers a loss of timing memory with the result that a driving signal is produced when the new battery is connected into the circuit irrespective of the state of the display device as indicated by its persistence. As a consequence bleached and colored display elements are driven even further into their respective existing states of display and are charged in excess of their prescribed value. This will result in an indistinct display during the subsequent reverse driving operation since adequate reversal of the applied charge will not be possible.

(2) When driving is effected in a regenerative manner it is necessary to perform the driving operation while an adequate display is maintained; that is, at such time that a considerable quantity of the electrical charge still remains. In this case also a charge will be applied in excess of the prescribed value directly after the regenerative driving operation and a problem identical to that described in (1) will arise. It is possible to avoid this difficulty by selecting from the outset a suitably high value for the magnitude of the charge but this will have a deleterious effect upon power consumption and hasten the deterioration of the display device.

(3) When driving the display devices in the opposite direction the previously stord electrical charge is discharged through the power supply which is an unnecessary waste of power.

It is, therefore, an object of the present invention to provide an improved driver circuit for an electro-optical display device having a persistence effect.

It is another object of the present invention to provide a driver circuit which is capable of driving an electro-optical display device in a highly distinct manner.

It is another object of the present invention to provide a driver circuit which is capable of driving an electro-optical display device so as to increase its operating life.

It is still another object of the present invention to provide a driver circuit which is capable of reducing power consumption required for driving an electro-optical display device.

It is a further object of the present invention which is simple in construction and highly reliable in operation.

These and other objects, features and advantages of the present invention can be more apparent from the following description when taken in conjunction with the accompanying drawings, in which.

Before entering into a detailed description of the present invention it should be noted that "reverse driving" will be taken to mean a driving operation performed so as to change the state of a display and "regenerative driving" will be defined as a driving operation performed in order to compensate for deterioration in the persistence of a display device without actually altering the display.

Figure 1:
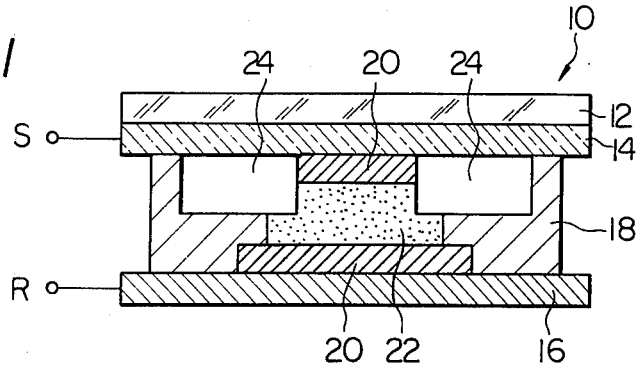
FIG. 1 is a cross sectional view of a structure of an electrochromic cell to which a driver circuit of the present invention can be applied.

Referring now to FIG. 1, there is schematically shown a preferred example of an electrochromic display device to which the present invention is directed. As shown, the display device 10 comprises a transparent glass layer 12, a transparent electrode 14 secured to the transparent glass layer 12 and consisting of $In_2O_3$, and a stainless steel layer 16 spaced from the transparent electrode 14 by a bonding agent 18 serving as a spacer. Reference numeral 20 indicates electrochromic layers consisting of, for example, $WO_3$ between which an electrolyte 22 is disposed. Reference numeral 24 indicates layers of $SiO_2$ disposed between the transparent electrode 14 and the bonding agent 18. As shown, the transparent electrode 14 and the stainless steel layer 16 are connected to terminals S and R, respectively.

Figure 2:
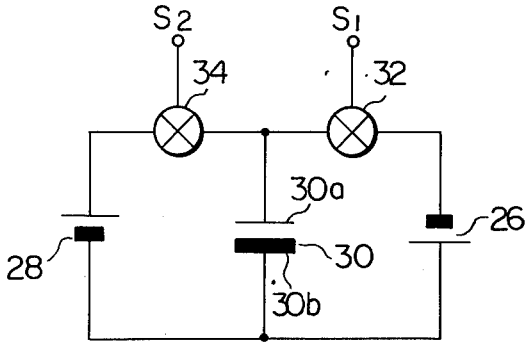
FIG. 2 is a circuit diagram showing a conventional driving method.

FIG. 2 shows an example of a conventional driver circuit. In FIG. 2, the conventional driver circuit comprises batteries 26 and 28 connected in series, an electrochromic display element 30 connected in parallel to the batteries 26 and 28, a first switch 32 connected between a segment electrode **30*a* and the negative potential side of the battery 26, and a second switch 34 connected between the segment electrode 30*a* and the positive potential side of the battery 28. With this arrangement, if the first switch 32 is closed, the battery 26 applies electrical charge to the display element 30 which accordingly assumes a colored state; the display element 30 remains in the colored state while the charge Q is stored even after the first switch 32 is opened. Next when the second switch 34 is closed the stored charge Q is discharged through the battery 28 and a negative charge −Q is applied which causes the display element 30 to bleach. Opening the second switch 34 stores the charge −Q and the display element 30** remains in the bleached state.

The density of coloration depends upon the magnitude of the applied charge Q and is saturated to a certain extent. Moreover, as the application of an excessive charge wastes power and contributes to the deterioration of the display element, the advisable magnitude of the applied charge should be as small as the conditions will permit. The magnitude of the charge to be applied is a function of the battery voltage and the time interval over which the driving operation is performed. Although display elements in the colored or bleached state remain in their respectively charged states after having been disconnected from the power source, the display conditions tend to become unstable with the passage of time due to self-discharge or the effects of external light. Consequently, in order to maintain a display over a long period of time it is necessary to regenerate the display over a suitably established time interval by means of a regenerative driving method.

Figure 3:
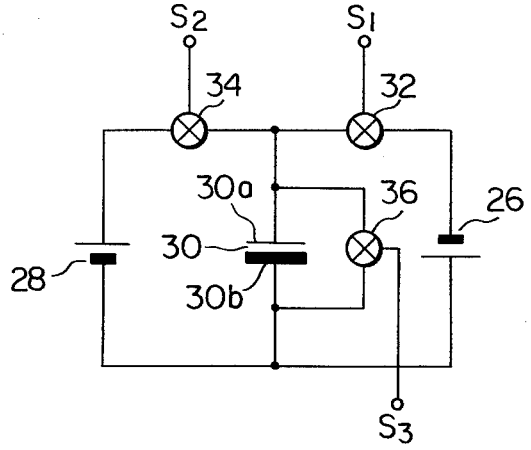
FIG. 3 is a circuit diagram showing a principal concept of the present invention.

FIG. 3 shows a schematic circuit diagram illustrating a principal concept of the present invention to solve the above problems. In FIG. 3, a driver circuit is provided with a third switch 36 for the purpose of short-circuiting both electrodes of the display element 30.

Figure 4A:
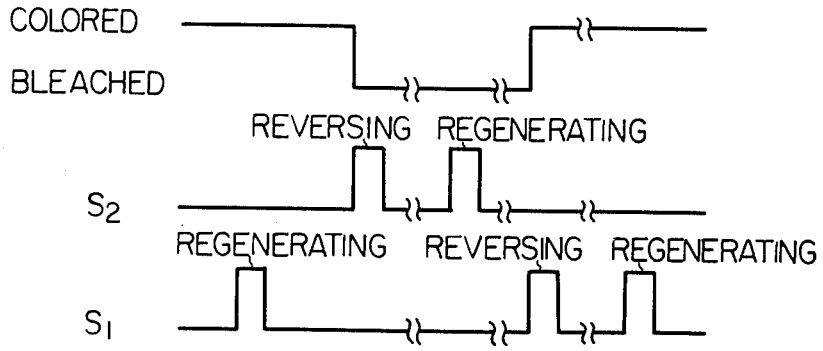
FIG. 4A is a waveform diagram illustrating the operation of the circuit shown in FIG. 2.
Figure 4B:
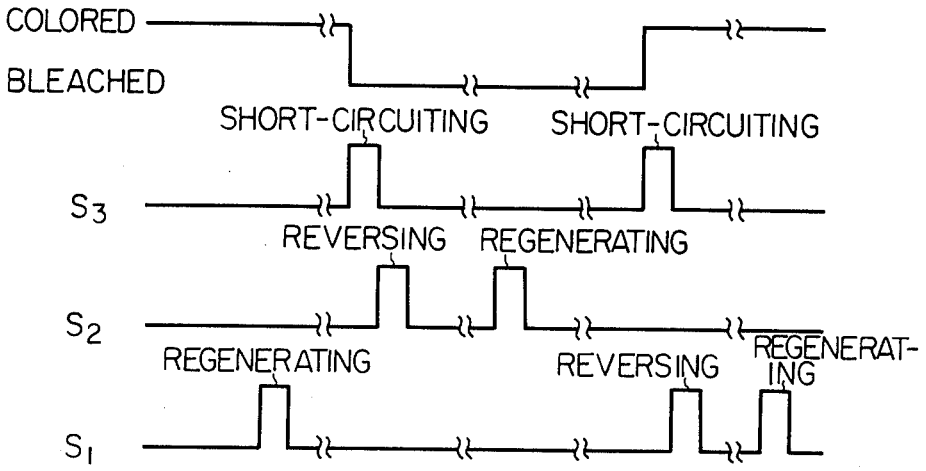
FIG. 4B is a waveform diagram illustrating the operation of the circuit shown in FIG. 3.

FIG. 4A shows an example of control waveforms employed in conventional driving method and FIG. 4B the control waveforms in accordance with the present invention. In FIG. 4B, S1, S2 and S3 designate signals which result from the opening and closing of respective switches 32, 34 and 36, the upper levels of the signals denoting the conductive state of their corresponding switches. In FIG. 4A, a display element is driven in the reverse direction immediately at such time that it becomes necessary to reverse the state of a display from bleached to colored or from colored to bleached after which a suitable interval of time passes before a regenerative driving operation is performed. As opposed to this the present invention first short-circuits both electrodes of the display element when a reversal is necessary and thus neutralizes the displayed state before executing the reversal of the driving operation. This procedure obviates the above-mentioned problems and permits normal reversal of the driving operation while conserving electrical power.

Figure 5:
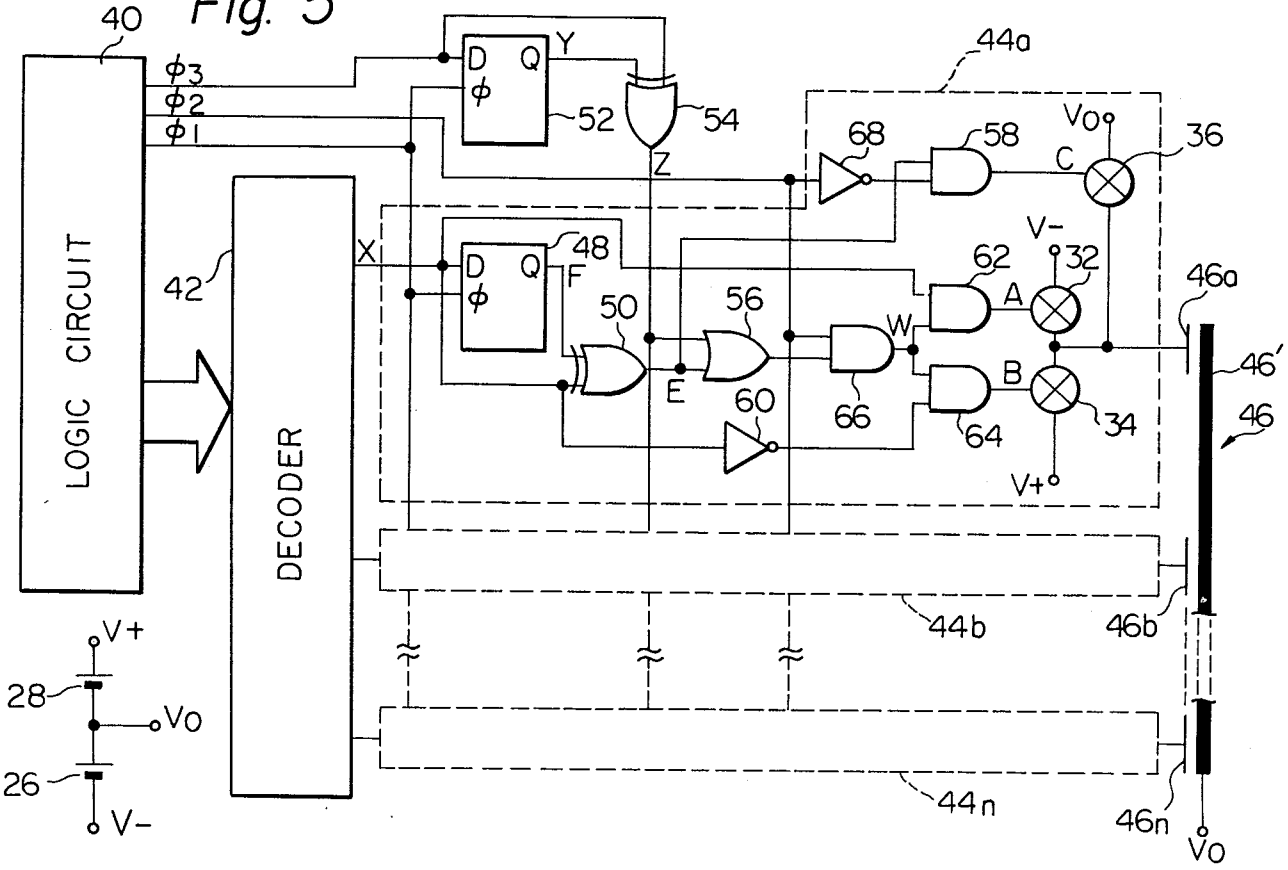
FIG. 5 is a preferred embodiment of a driver circuit according to the present invention.

FIG. 5 shows a preferred embodiment of a driver circuit according to the present invention. In FIG. 5, reference number 40 denotes a logic circuit arranged to provide binary coded output signals and various clock signals $\phi_1$, $\phi_2$ and $\phi_3$, 42 denotes a decoder adapted to generate display information signals in response to the binary coded signals from the logic circuit 40 and *44a*, *44b*, . . . *44n* are identically constructed driver circuits which correspond to the respective segments of a display device 46.

The output signal X obtained from the decoder 42 corresponding to the segment electrode *46a* of the display device 46 is applied to the data input terminal of a latch circuit 48 the output F of which in turn is supplied to one input terminal of an exclusive OR gate 50. A clock signal $\phi_1$ as supplied by the logic circuit 40 is applied to the clock input terminal of the latch circuit 48. This clock signal is also applied to the clock input terminal of another latch circuit 52 the data input terminal of which is provided with a regenerative drive timing clock signal $\phi_3$. The output Y of the latch circuit 52 is applied to one input terminal of an exclusive OR gate 54 the other input terminal of which is provided with the clock signal $\phi_3$. The output Z of the exclusive OR gate 54 is connected to one input terminal of an OR gate 56.

Another input terminal of the OR gate 56 is connected to both the output terminal E of the exclusive OR gate 50 and to one input terminal of an AND gate 58. The remaining input terminal of the exclusive OR gate 50 is connected to the data input terminal of the latch circuit 48, the output terminal of the decoder 42, the input terminal of an inverter 60 and one input terminal of an AND gate 62. The output terminal of the inverter 60 is connected to one input terminal of an AND gate 64 while the remaining input terminal of gate 64 is connected to the remaining input terminal of the AND gate 62 and to the output terminal of an AND gate 66. One input terminal of the AND gate 66 is connected to the output terminal of the OR gate 56 while the remaining input terminal is connected to the input terminal of an inverter 68 and provided with a clock signal $\phi_2$ as supplied by the logic circuit 40. The output terminal of the inverter 68 is connected to the remaining input terminal of the AND gate 58.

The outputs A and B of the AND gates 62 and 64 are connected to the first and second switches 32 and 34, respectively. The output C of the AND gate 58 is connected to the third switch 36. The first switch 32 may comprise an N-channel metal oxide semiconductor field effect transistor having its source terminal coupled to the negative potential side $V_-$ of the battery 26, the gate terminal connected to the output of the AND gate 62, and the drain terminal connected to the segment electrode *46a* of the display device 46. Likewise, the second switch 34 may comprise a P-channel metal oxide semiconductor field effect transistor having its source terminal connected to the positive potential side $V_+$ of the battery 28, the gate terminal connected via an inverter (not shown) to the output of the AND gate 64, and the drain terminal connected to the segment electrode *46a*. The drain terminals of the first and second switches 32 and 34 are coupled together. The third switch 36 may comprise a semiconductor field effect transistor having its source terminal connected to a reference potential Vo between the batteries 26 and 28, the gate terminal connected to the output of the AND gate 58, and the drain terminal connected to the segment electrode *46a*.

The common electrode 46' of the display device 46 is connected to the reference voltage Vo. The positive electrode of the battery 28 serves as the high potential $V_+$, the negative electrode of the battery 28 and the positive electrode of the battery 26 provide the reference potential Vo, and the negative electrode of the battery 26 serves as the low potential $V_-$.

The latch circuits 48 and 52 may comprise data-type latches which perform a latch function when the clock inputs are at a low potential. Clock signals $\phi_1$ and $\phi_2$ and the output of the exclusive OR gate 54 are also supplied in an identical manner to the driver circuit blocks 44b . . . . *44n* corresponding to each remaining segment electrode.

Figure 6:
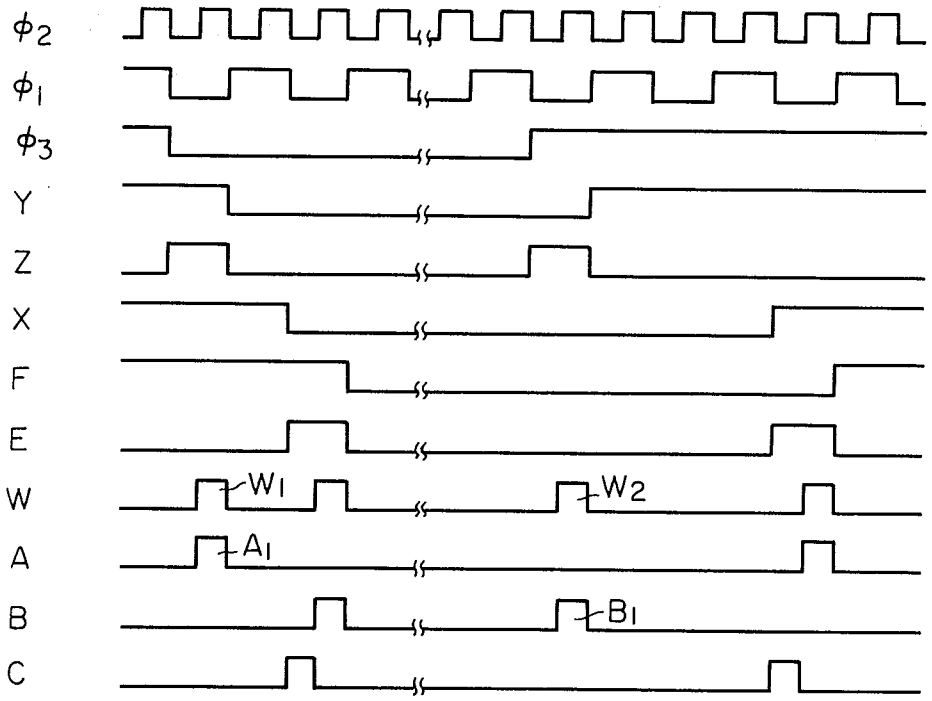
FIG. 6 is a waveform diagram illustrating the operation of the circuit shown in FIG. 5.

FIG. 6 shows the waveforms illustrating the operation of the principle portions of the circuit shown in FIG. 5. Clock signal $\phi_1$ having a frequency one-half that of clock signal $\phi_2$ changes state whenever the state of clock signal $\phi_2$ changes from a high to a low level. Clock signal $\phi_3$ has a waveform at a predetermined frequency obtained by dividing the frequency of clock signal $\phi_1$ through several stages and is employed to determine the timing of the regenerative driving operation. When clock signal $\phi_3$ is applied to the latch circuit 52, it generates an output Y delayed in phase by the period of clock signal $\phi_2$, with the result that the exclusive OR gate 54 generates an output Z as a regenerative timing signal in a predetermined sequence for a duration equivalent to the period of clock signal $\phi_2$. The output Z is utilized for generating auxiliary drive signals to regeneratively drive each display element to maintain the same in the colored or bleached state. To this end, the output Z is applied to the one input of the OR gate 56. Similarly, the output X is applied to the data input terminal D of the latch circuit 48, which generates an output F in synchronism with the rising edge of clock signal $\phi_1$. The outputs X and F are applied to the exclusive OR gate 50, which generates an output E. The outputs Z and E are gated through the OR gate 56 to the AND gate 66, to which clock signal $\phi_2$ is also applied so that the AND gate 66 generates an output W as shown in FIG. 6. The output W is applied to the AND gate 62, to which the output X is also applied so that the AND gate 62 generates an output A. The output W is also applied to the AND gate 64, to which the output X is also applied via the inverter 60. Thus, the AND gate 64 generates an output B. Consequently, if the output X attains an "H" level the output signal A from the AND gate 62 rises to an "H" level. In this case, the first switch 32 is turned on and the segment electrode **46*a* is connected to $V_-$ to drive the display device 46 in a direction as will induce the colored state. For a case in which the signal X goes to a low potential level "L" the output signal B from the AND gate 64 attains an "H" level, the second switch 34 is turned on and the segment electrode 46*a* is connected to $V_+$ to drive the display device 46 in a direction as will induce the bleached state. When the output Z goes to a high level, the AND gate 66 is opened to pass the clock signal $\phi_2$ as output pulses $W_1$ and $W_2$. The output pulse $W_1$ is applied to the AND gate 62, by which an auxiliary drive signal $A_1$ is generated to regeneratively drive the segment electrode 46*a* in its colored state. Likewise, the output $W_2$ is applied to the AND gate 64, by which an auxiliary drive signal $B_1$ is generated to regeneratively drive the segment electrode 46*a*** in its bleached state.

When the decoder output signal X changes from an "H" to an "L" or from an "L" to an "H" level, the output signal F produced by the latch circuit 48 changes in the same manner delayed by the period of clock signal $\phi_2$ and the output signal E generated by the exclusive OR gate 50 attains an "H" level for duration equivalent to the period of this clock signal. The output signal C of the AND gate 58 will thus attain an "H" level for the "L" level portion of clock signal $\phi_2$, the third switch 36 is turned on and the segment electrode **46*a* is short-circuited to Vo before the drive signal is applied to the first or second switch 32 or 34. When clock signal $\phi_2$ is at an "H" level the output of the gate 62 or 64** will attain an "H" level and reverse driving is performed.

It will now be appreciated from the foregoing description that in accordance with the present invention each display element of an electro-optical display device is short-circuited before the display element is driven into first or second display state whereby distinct display of information can be obtained and power consumption can be minimized while increasing the life of the electro-optical display device.

While the present invention has been shown and described with reference to particular embodiments, it should be noted that various other changes or modifications may be made without departing from the scope of the present invention.

What is claimed is:

1. A driver circuit for an electro-chromic display device having a persistence effect and a plurality of display elements adapted to display information in response to display information signals, comprising:

means for generating first and second drive signals in response to a change of each display information signal for thereby driving said each display element; and means for generating control signals just prior to said drive signals in response to said change of said each display information signal for thereby short-circuiting said each display element just prior to driving said each display element;

said first and second drive signals having a narrow pulse width, whereby said each display element is driven only for predetermined short time intervals and maintained in its open state during time intervals other than said predetermined short time intervals to display said information due to its persistence effect.

2. A driver circuit for an electro-chromic display device having a persistence effect and a plurality of display elements adapted to display information in response to display information signals, comprising:

means for generating first and second drive signals in response to a change of each display information signal for thereby driving said each display element, said drive signal generating means including a latch circuit for storing said each display information signal and generating a first output delayed in phase with respect to said each display information signal, first gate means for generating a second output in response to said each display information signal and said first output, said second output representing said change of said each display information signal, second gate means for generating a third output having a narrow pulse width in response to said second output and a clock pulse having a pulse width equal to said narrow pulse width, third gate means for generating said first drive signal in response to said each display information signal and said third output, and fourth gate means for generating said second drive signal in response to said third output and an inverted value of said each display information signal; and means for generating control signals just prior to said drive signals in response to said change of said each display information signal for thereby short-circuiting said each display element just prior to driving said each display element, said control signal generating means including gate means for generating said control signals just prior to said first and second drive signals in response to said second output and said clock pulse whereby said each display element is driven just after an electrical charge stored in said each display element has been discharged;

said first and second drive signals having a narrow pulse width, whereby said each display element is driven only for predetermined short time intervals and maintained in its open state during time intervals other than said predetermined short time intervals to display said information due to its persistence effect.

3. A driver circuit for an electro-chromic display device having a persistence effect and a plurality of display elements adapted to display information in response to display information signals, comprising:

means for generating first and second drive signals in response to a change of each display information signal for thereby driving said each display element;

means for generating control signals just prior to said drive signals in response to said change of each said display information signal for thereby short-circuiting said each display element just prior to driving said each display element said control signal generating means including gate means for generating said control signals prior to said first and second drive signals in response to said change of display information signal and a clock pulse having a narrow pulse width; and means for applying regenerative timing signals to said drive signal generating means whereby said drive signal generating means generates auxiliary drive signals to regeneratively drive said each display element to maintain said each display element in its first and second display states;

said first and second drive signals having a pulse width equal to said narrow pulse width, whereby said each display element is driven only for predetermined short time intervals and maintained in its open state during time intervals other than said predetermined short time intervals to display said information due to its persistence effect.

4. A driver circuit for an electro-chromic display device having a persistence effect and a plurality of display elements adapted to display information in response to display information signals, comprising:

a source of first and second clock pulses, said first clock pulse having a frequency higher than that of said second clock pulse;

means for storing each of said display information signals and generating a first output delayed in phase from said each display information signal in response to said second clock pulse;

means for generating a second output in response to said each display information signal and said first output;

means for generating first and second drive signals in response to said first clock pulse and said second output;

electronic switching means responsive to said first and second drive signals for driving each of said display elements; and means for generating a control signal just prior to each of said first and second drive signals in response to said second output and said first clock pulse for short-circuiting said each display element to discharge an electrical charge stored in said each display element just prior to driving said each display element;

said first and second drive signals having a pulse width equal to said first clock pulse, whereby said each display element is driven only for predetermined short time intervals and maintained in an open state during time intervals other than said predetermined short time intervals to display said information due to its persistence effect.

5. A driver circuit according to claim 4, in which said storing means comprises a latch circuit having a data input terminal adapted to receive said each display information signal, a clock input terminal responsive to said second clock pulse.

6. A driver circuit according to claim 4, in which said second output generating means comprises an Exclusive OR gate having one input adapted to receive said first output and another input adapted to receive said each display information signal.

7. A driver circuit according to claim 4, in which said drive signal generating means comprises a first gate responsive to said second output and said first clock pulse to generate third output, a second gate responsive to said display information signal and said third output to generate said first drive signal, and a third gate responsive to said third output and an inverted value of said display information signal to generate said second drive signal.

8. A driver circuit according to claim 4, further comprising first switching means responsive to said first drive signal to apply an electric current to said each display element in a direction to induce a first display state, second switching means responsive to said second drive signal to apply an electric current in a direction to induce a second display state, and third switching means responsive to said control signal to cause said each display element to be short-circuited.

9. A driver circuit according to claim 8, in which each of said switching means comprises a semiconductor field effect transistor.

10. A driver circuit according to claim 4, further comprising means for applying regenerative timing signals to said drive signal generating means whereby said drive signal generating means generates auxiliary drive signals to regeneratively drive said each display element to maintain said each display element in its first and second display states, respectively.

11. A driver circuit according to claim 10, in which said timing signal applying means comprises means for generating an output signal at a predetermined frequency, and gate means for generating said regenerative timing signals in response to said output signal.

* * * * *